US006796355B2

(12) United States Patent
Huthmacher et al.

(10) Patent No.: US 6,796,355 B2
(45) Date of Patent: Sep. 28, 2004

(54) HAND-HELD DEVICE FOR TRANSFERRING A FILM FROM A BACKING STRIP ONTO A SUBSTRATE HAVING BACKING TAPE REELS ARRANGED NEXT TO EACH OTHER

(75) Inventors: Winfried Huthmacher, Frankfurt (DE); Georg Semmler, Wiesbaden (DE); Roland Schneider, Kelkheim (DE)

(73) Assignee: Societe BIC (FR)

( * ) Notice: Subject to any disclaimer, the term of this patent is extended or adjusted under 35 U.S.C. 154(b) by 0 days.

(21) Appl. No.: 10/226,231

(22) Filed: Aug. 23, 2002

(65) Prior Publication Data

US 2003/0024652 A1 Feb. 6, 2003

Related U.S. Application Data

(63) Continuation of application No. PCT/EP01/01584, filed on Feb. 13, 2001.

(30) Foreign Application Priority Data

Feb. 25, 2000 (EP) ..... 00103995

(51) Int. Cl.[7] ..... B32B 31/00

(52) U.S. Cl. ..... 156/577; 156/523; 156/579; 118/76; 118/257; 242/160.4; 242/171; 242/588.6

(58) Field of Search ..... 156/523, 577, 156/579, 574, 527, 328, 538, 540; 118/200, 257, 76; 206/411; 242/170, 171, 588.3, 588.2, 588.6, 588, 160.2, 160.4; 225/46

(56) References Cited

U.S. PATENT DOCUMENTS

| | | | | |
|---|---|---|---|---|
| 5,006,184 A | 4/1991 | Manusch et al. | ..... | 156/577 |
| 5,679,156 A | 10/1997 | Matsumaru | ..... | 118/200 |
| 5,942,036 A | 8/1999 | You | ..... | 118/257 |
| 6,079,660 A | 6/2000 | Manusch et al. | ..... | 242/538.1 |
| 6,206,072 B1 | 3/2001 | Orihara et al. | ..... | 156/540 |
| 6,521,045 B1 * | 2/2003 | Koyama et al. | ..... | 118/251 |

FOREIGN PATENT DOCUMENTS

| | | | |
|---|---|---|---|
| DE | 41 04 331 | 8/1992 | |
| DE | 42 20 712 | 1/1994 | |
| JP | 2000-25393 | 1/2000 | |
| WO | WO 9733824 A1 * | 9/1997 | ..... B65H/37/00 |

* cited by examiner

*Primary Examiner*—Richard Crispino
*Assistant Examiner*—Cheryl N. Hawkins
(74) *Attorney, Agent, or Firm*—Jones Day

(57) ABSTRACT

The invention relates to a device for transferring a film of adhesive, covering, or colored material from a backing tape onto a substrate, having a housing in which a supply reel and a take-up reel for the backing tape are rotatably mounted. The backing tape extends from the supply reel, loops around an application member protruding from the housing, and extends to the take-up reel. A rotating member is arranged in the drive connection between the supply reel and the take-up reel. The rotating member is connected to the take-up reel by a first gearing and has a rotational axis which is radially offset in relation to the rotational axis of the supply reel. The rotational axis of the supply reel is radially offset relative to the rotational axis of the rotating member.

24 Claims, 1 Drawing Sheet

HAND-HELD DEVICE FOR TRANSFERRING A FILM FROM A BACKING STRIP ONTO A SUBSTRATE HAVING BACKING TAPE REELS ARRANGED NEXT TO EACH OTHER

CROSS-REFERENCE TO RELATED APPLICATIONS

The present application is a continuation of the U.S. National Stage designation of co-pending International Patent Application PCT/EP01/01584, filed on Feb. 13, 2001, which claims priority to European Patent Application 00 103 995.7, filed Feb. 25, 2000. The entire content of both these applications is expressly incorporated herein by reference thereto.

FIELD OF THE INVENTION

The present invention relates to a device for transferring a film from a backing tape onto a substrate having backing tape reels arranged next to each other.

BACKGROUND OF THE INVENTION

In this type of device, the take-up speed of the take-up reel has to be at least as great as the unwinding speed of the supply reel, otherwise loops can form in the take-up film strip of the take-up tape which can impair take-up so much that the device is unusable. When abiding by this speed condition, it has to be taken into account that the respective effective winding diameters of the supply reel and the take-up reel change and therefore the take-up speed is dependent on the respective winding size of the supply reel. To guarantee problem-free take up, a drive connection between the supply reel and the take-up reel has been developed which seeks to take up the backing tape at a speed which is greater than the unwinding speed, a differential gear being provided in the drive connection between the supply reel and the take-up reel which guarantees that the supply and take-up speeds are always equal and that a specific tautness in the backing tape running onto the take-up reel is not exceeded. Such a differential gear can, for example, be formed by a sliding clutch. This guarantees that the backing tape is always wound up with a certain tension, the sliding clutch ensuring that the backing tape cannot rip. Such a differential gear or such a sliding clutch is described for example in DE 42 20 712 C2. In this known device, the supply reel and the take-up reel are arranged in a common plane of rotation. Although this allows a narrow construction to be achieved in the axial direction of the reels, a relatively large construction is required in the radial direction of the reels.

To obtain a small construction in the radial direction, devices which have the supply reel and the take-up reel arranged axially offset with respect to each other and next to each other have already been developed. DE 41 04 331 C2 shows a construction in which the supply reel and the take-up reel are borne on a common rotational axis, a friction element in the form of a foam ring being arranged between the reels to thus form the sliding clutch. Given the constantly changing winding diameters of the reels in the operating mode, it is difficult in such a design to ensure that the take-up speed is always at least as great as the supply speed. Because the reels are arranged axially offset and next to each other, this produces two winding planes for the backing tape which are arranged next to each other. Due to the presence of the backing tape loop extending between the reels and the affiliated application member, the unwinding and winding up of the backing tape onto the reels arranged next to each other is guaranteed. In this known device, the reel diameters have to have dimensions which differ such that the above-described condition is fulfilled. This requires a larger construction in the radial direction.

A design similar to the design described above is provided in a device according to DE 38 37 621 C2 (corresponding to U.S. Pat. No. 5,006,184 to Manusch et al.). In this known design, the differential gear or the sliding clutch is formed by a tooth-wheel drive which works between the reels, the teeth of one of the toothed rings being formed on pliably arranged spring arms so that the speed of the tooth drive can be increased as necessary in the sense of a sliding clutch. Furthermore, the reels may be arranged axially next to each other but the rotational axes of the reels enclose an obtuse angle open towards the application member so that the unwinding backing tape strip and the winding up backing tape strip—seen transversely to the rotational axes—extend at an acute angle towards the application member and therefore the backing tape take-up and supply is improved.

Another device of the type described above with reels which are arranged axially offset next to each other is described in DE 196 09 533 C1 (corresponding to U.S. Pat. No. 6,079,660 to Manusch et al.). In this known embodiment, the reels are in direct abutment on their mutually facing sides but are rotatably mounted about two rotational axes which are radially offset from each another. Both of the reels are formed as hollow reels with a step-up gearing being arranged as a toothed gearing in the free hollow space of the supply reel between the supply reel and an inner pinion. The gearing is formed on a rotating part which protrudes axially beyond the supply reel and has a rotary bearing part in this protruding part on which the take-up reel is rotatably mounted by means of a cylindrical bearing boss. On its circumference, the bearing member has a plurality of spring arms which are elastically prestressed radially against the boss walls of the take-up reel, thus forming a sliding clutch which enables the speed to be balanced, as described above. In this known design, it is necessary, considering the transmission ratio between the supply reel and the rotating part forming the inner toothed wheelwork, for the take-up reel to have a certain minimum diameter. In the design inferred by this publication, the take-up reel is considerably larger than the supply reel. This also makes it necessary to have an enlarged construction in the radial direction.

A device having a construction similar to the construction described above is known in DE 196 11 440 A1 (corresponding to U.S. Pat. No. 5,679,156 to Matsumaru). In this known design, a support wall of an insertion member is arranged between the radially offset and axially adjacent reels, with a step-up gearing not being arranged inside the reel but in the radial offset region between the reels.

It therefore would be desirable to form a device of the type described above such that a better economy of space and also a small, handy design can be achieved.

SUMMARY OF THE INVENTION

The present invention provides a compact device for transferring film from a backing strip to a substrate, the device comprising a housing containing a stock of tape, a supply reel, a take-up reel, an application member extending from an opening in the housing, and a gear arrangement between the supply reel and the take-up reel. The tape is supplied from the supply reel, passed over the application member, and rewound onto the take-up reel. The application member presses the tape on an application surface during operation of the device.

In one embodiment, the supply reel and the take-up reel are non-coplanar and the gear arrangement includes a rotating member or rotating part (referenced herein as a rotating member for the sake of convenience without any intent to limit) rotatable about a rotational axis. The rotational axis of the take-up reel can be arranged radially offset relative to the rotational axis of the rotating member. The position of the take-up reel can be radially offset relative to the rotational axis of the rotating member in any direction within the bounds of the possible eccentric arrangement, thus producing a way of adapting to the housing of the device and therefore making it possible to optimally exploit the interior of the housing. A small, compact construction can therefore be achieved. This advantage is particularly beneficial because the device is handled manually when in use and the size range available is therefore limited.

In addition, it is possible to arrange a gear arrangement, a drive connection, or a revolution-regulating gearing (referenced herein as a gear arrangement for the sake of convenience without any intent to limit) between the rotating member and the take-up reel in a simple manner, thus advantageously using the available component size and, where appropriate, also the design as a whole.

The gear arrangement may be arranged between the rotating member and the take-up reel This gearing can be a step-up gearing or a step-down gearing depending on the construction of the device. This embodiment of the invention makes it possible to reach a minimum number of revolutions or a minimum winding speed for the take-up reel in a restricted amount of space. It will be appreciated that, although a change in the number of revolutions can also be achieved with the known gear arrangement, the step-up ratio or the step-down ratio of the gear arrangement is restricted because of the limited amount of space available. In an embodiment of the invention, however, two revolution-regulating gears are present in two spaces located next to each other so that not only a better economy of space, but also a larger speed regulation is achieved. The latter is of particular importance with regard to achieving the smallest possible construction because a small construction also leads to relatively small winding diameters, particularly of the take-up reel. This means that the embodiment according to the invention also makes it possible to obtain a required minimum number of revolutions or minimum winding speed when the take-up reel has small dimensions.

A particularly simple embodiment is produced when the gear present between the rotating member and the take-up reel is a friction wheel gear. Such a gear is not just characterized by a simple and inexpensive construction and a reliable function, it also allows the differential gear or the sliding clutch to be integrated in a friction wheel coupling, thus obtaining a particularly simple, inexpensive, and yet reliably functioning embodiment.

The friction wheel gear is particularly simply configured when, of two radial walls which abut each other with axial stress, one or both friction wheel walls are resiliently flexible and bear upon each other with an inherent elastic stress. This type of embodiment does not require any special components, e.g., a spring, to produce the elastic pressure for the desired conveyance. The tension required for the friction is achieved in the mounting of the rotating member of the second reel by the frictional stress being caused in the predetermined positions of the parts as a result of the radial walls having dimensions which are smaller or larger than specified.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
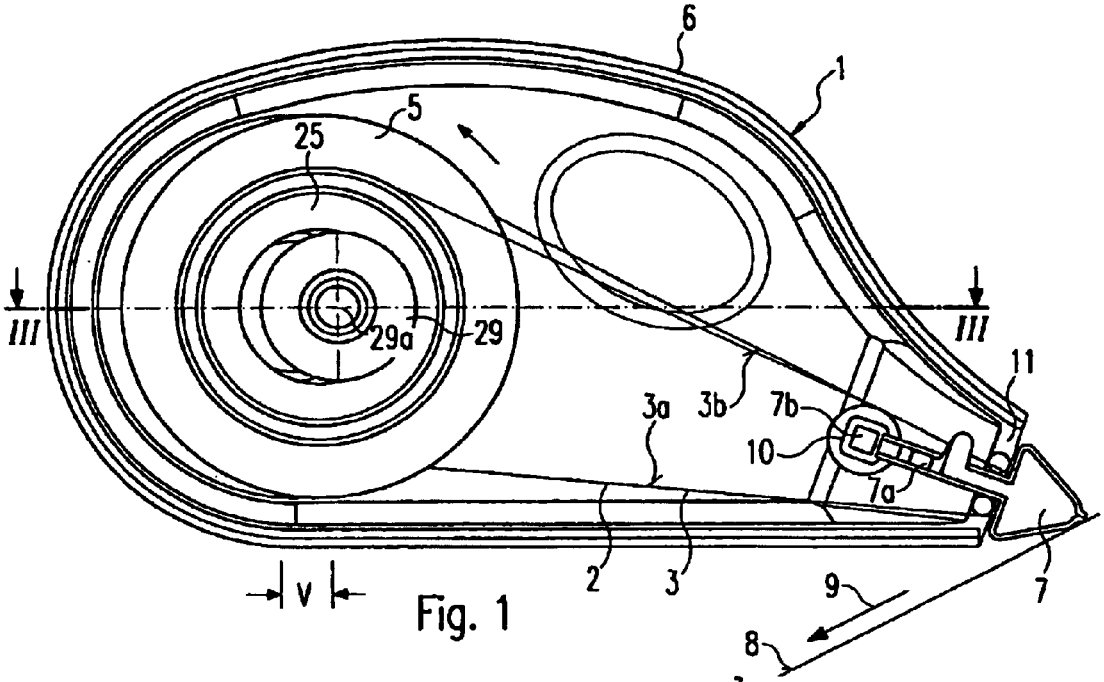
FIG. 1 is a side elevational view of a device formed in accordance with the principles of the present invention having a flat, upright housing consisting of two half shells, with one housing part removed so that the inside of the other housing part can be viewed.
Figure 2:
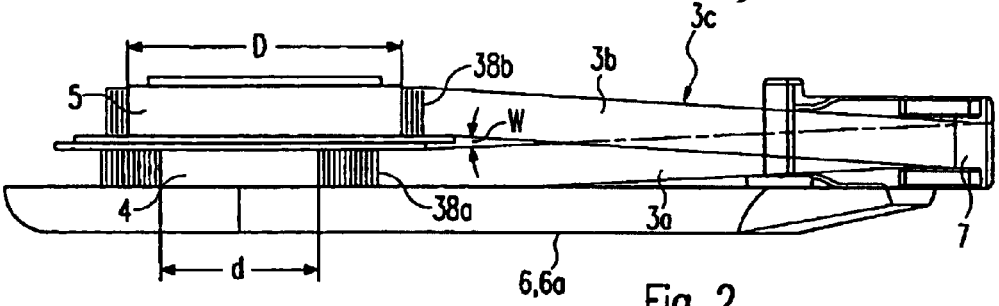
FIG. 2 is a device according to FIG. 1 as viewed from below.

Embodiments of the invention are described below by referring to the drawings. Exemplary devices formed in accordance with the principles of the present invention are illustrated in FIG. 1 through FIG. 4, in which same reference numbers refer to similar constituent components or elements.

The device of the present invention, generally denoted as 1, as shown in FIG. 1, serves to transfer a film 2 adhered to a backing tape 3 onto a substrate, backing tape 3 being wound up on a supply reel 4 and a take-up reel 5 in a housing 6. The backing tape 3 forms a loop 3*c* with its supply film strip 3*a* running from supply reel 4 and its take-up film strip 3*b* running onto take-up reel 5. This loop 3*c* loops around an application member 7 projecting from housing 6. When in use, supply film strip 3*a* of loop 3*c* is pulled off supply reel 4 while take-up film strip 3*b* is automatically wound up onto take-up reel 5 when application member 7 is manually pressed onto substrate 8 at the same time device 1 is moved in the unwinding direction of backing tape 3 (see arrow 9 in FIG. 1). Housing 6 has a flat or disc-shaped construction and a size which allows it to be gripped and held in a user's hand in a user-friendly manner. In the present exemplified embodiment, housing 6 is arranged upright in its operating position and tapers wedge-like towards application member 7, which extends from the interior of housing 2 through an opening 11 to the outside. The broad side walls of housing 6 are denoted by reference numbers 12, 13. Between walls 12, 13 there extends a narrow-sided peripheral wall 14 in which opening 11 is formed with such a size that loop 3*c* can slide out of housing 6 and slide back in again between application member 7 and the affiliated opposing edges of opening 11.

Figure 3:
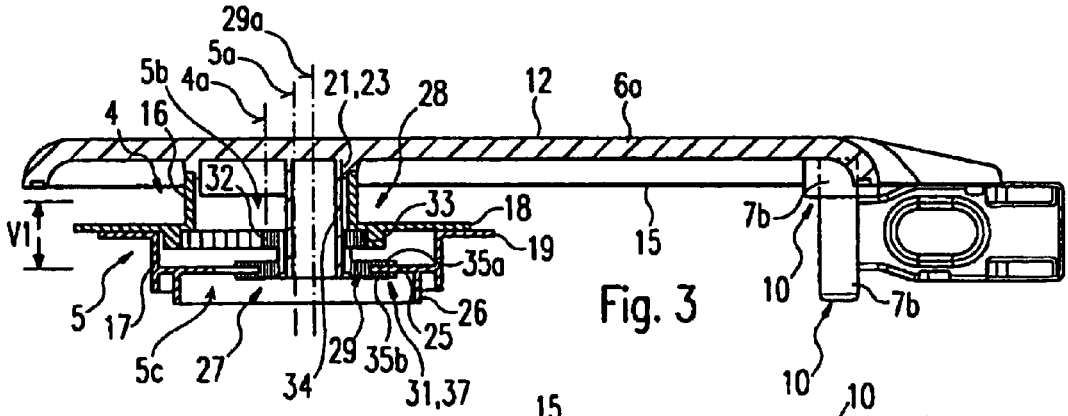
FIG. 3 is a cross-sectional view along line III—III in FIG. 1.
Figure 4:
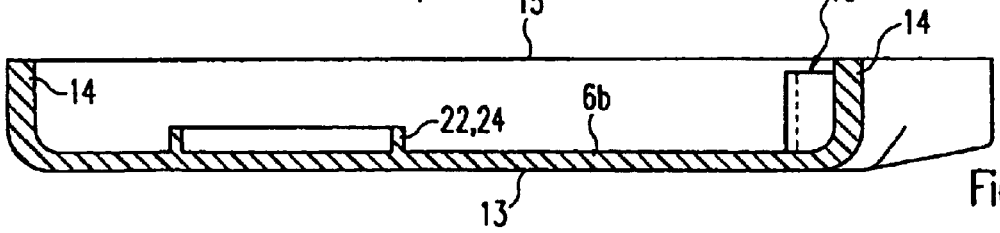
FIG. 4 is a cross-sectional view, similar to the view in FIG. 3, of the other housing shell of the device of FIG. 1 (but not illustrated in FIG. 1).

As shown in FIGS. 3 and 4, housing 6 consists of two housing parts or housing shells 6*a*, 6*b*, the division joint 15 of which can extend centrally or off-centrally parallel to side walls 12, 13. In the present embodiment, application member 7 is formed by a spatula-shaped element, shaft 7*a* of which is connected to one or both housing shells 6*a*, 6*b* with transversely extending insertion spigots 7*b* through a plug-in socket 10. Device 1 is particularly suited to transferring a film 2 of covering and/or colored and/or adhesive material. Among other possibilities, a pressure-exerting roller can be favorably used to transfer an adhesive film 2. Within the framework of the invention, other application members 7 can also be used.

As shown in FIG. 3, reels 4, 5 are positioned next to each other with their rotational axes 4*a*, 5*a* being arranged radially offset from each other so that each reel 4, 5 is rotatably mounted about its own rotational axis. In the present exemplary embodiment, supply reel 4 is formed with a smaller reel diameter than the reel diameter of take-up reel 5. The rotational axis 5*a* of take-up reel 5 is arranged such that it is offset towards application member 7 relative to rotational axis 4*a* of supply reel 4, this offset value V being between approximately 5 and 15 mm, especially approximately 9 mm. This offset guarantees that, bearing in mind the respective winding diameters when supply reel 4 is full and take-up reel 5 is empty, or when supply reel 4 is empty and take-up reel 5 is full, the maximum winding diameters on the circumferential sections of reels 4, 5 facing toward application member 7 are at approximately the same level, saving on the length of housing 6. As a result of the lateral offset V1, supply and take-up film strips 3*a*, 3*b*—seen transversely from the rotational axes 4*a*, 5*a*—enclose an acute angle between them.

Reels 4, 5 (see FIG. 3) each comprise a respective cylindrical winding body 16, 17 which extends as one piece from a radial reel ring wall 18, 19. The corresponding pivot bearings 21, 22 are formed by high cylindrical ring bearings 23, 24 which are integrally formed on corresponding housing shell 6*a*, 6*b* and on which supply and take-up winding bodies 16, 17 can be placed and thus mounted.

As shown in FIG. 3, take-up reel 5 comprises an additional inner radial reel ring wall 25 which is located in take-up winding body 17 and is connected integrally and preferably in a central position in take-up winding body 17. The pivot bearing 22 for take-up reel 5 can also have an additional inner bearing sleeve 26 which extends in one piece from inner reel ring wall 25 towards associated housing shell 6*b* and can engage in ring bearing 24 with a small amount of play or sit on this ring bearing. Reel ring walls 18, 19 are arranged on the mutually facing sides of reels 4, 5, wherein they can also directly abut each other.

Between reels 4, 5 (see FIG. 3) there is provided a gear arrangement 27 having a first gearing 28, which is effective between supply reel 4 and a rotating member 29, and a second gearing 31, which is effective between rotating member 29 and take-up reel 5. First gearing 28 is a step-up gearing and is formed by a toothed wheelwork with an outer toothed ring 32 formed on rotating member 29 which meshes with an inner toothed ring 33 formed on supply reel 4, preferably on the side of supply reel 4 facing take-up reel 5, especially on reel ring wall 18. First gearing 28 is arranged in a hollow space 5*b* of supply reel 4 and hollow space 5*c* of take-up reel 5. The diameter of rotating member 29 is smaller than the diameter of inner toothed ring 33 and rotating member 29 is rotatably mounted on a third rotational axis 29*a* parallel to rotational axes 4*a*, 5*a* and running radially offset therefrom on a cylindrical bearing sleeve 34 which is integrally formed on housing shell 6*a*.

Second gearing 31 is arranged between rotating member 29 and take-up reel 5, also in hollow space 5*b* of take-up reel 5. In the present embodiment, second gearing 31 is a step-down gear on the one hand and a friction wheel gear on the other. The latter is formed by two radial flange walls 35*a*, 35*b* which extend fork-shaped beyond the inner edge section of reel ring wall 25, the distance between flange walls 35*a*, 35*b* being somewhat smaller than the thickness of reel ring wall 25. When mounting second gearing 31, reel ring wall 25 is pushed between flange walls 35*a*, 35*b*, whereby the latter are elastically spread apart. The resulting flexible clamping stress produces the friction of the friction wheel gear in the use mode. This forms a differential gear or a sliding clutch 37 with such a large carrying moment that the tensile stress produced in backing tape 3 during take-up is only so great that backing tape 3 is not over-strained. Reel diameters d, D are attuned to each other such that take-up reel 5 is always driven at a circumferential speed in the region of respective windings 38*a*, 38*b* which is greater than the unwinding speed of supply reel 4. Because of the effectiveness of sliding clutch 37, the backing tape 3 is consequently pulled taut during take-up, thus preventing a damaging loop formation. As a result of sliding clutch 37 sliding through, the take-up speed always corresponds to the supply speed.

Sliding clutch 37 is also capable of functioning when just one of two flange walls 35*a*, 35*b* is present and when this flange wall 35*a* or 35*b* and reel ring wall 25 press laterally against each other with axial elastic stress. This can be achieved by rotating member 29 and take-up reel 5 being designed to be offset by a corresponding axial variable, whereby, during mounting, one or both walls bend axially outwards and thus axial elastic stress is produced automatically.

Within the scope of the invention, it is also possible to create the frictional effect by means of elevations and recesses in the form of teeth with associated tooth spaces (not illustrated) which are preferably integrally formed in the region of ring zones of reel ring wall 25 and flange wall(s) 35*a*, 35*b* which are opposite each other and come into contact with each other. In such an alternative embodiment, reel ring wall 25 and flange wall 35*a* and/or 35*b* do not have to abut one another with axial stress. The torsional conveyance or the torque transmission is effected by a resiliently flexible positive locking by the teeth hitting against the sides of the tooth gaps in the rotational direction, wherein one or both of the walls present yield axially and thus the meshing is over-pressured when the torque to be transmitted exceeds a certain maximum un-damaging value for backing tape 3.

All the above-described parts of device 1 are made of plastic and, with the exception of backing tape 3 and film 2, can be manufactured with little time expenditure and machine effort by an injection molding method.

What is claimed is:

1. A device for transferring a film from a backing tape onto a substrate, said device comprising:

a housing;

a supply reel rotatably mounted in said housing about a supply reel rotational axis;

a take-up reel rotatably mounted in said housing about a take-up reel rotational axis;

an application member protruding from said housing to press backing tape extending from said supply reel onto a substrate; and a gear arrangement between said supply reel and said take-up reel and including a rotating member extending along a rotating member rotational axis in a hollow space within one of said supply reel and said take-up reel;

wherein:

said supply reel and said take-up reel are non-coplanar; and said near arrangement includes a gear tooth arrangement arranged between said rotating member and one of said supply reel and said take-up reel, and about an axis offset relative to the other of said supply reel and said take-up reel.

2. A device according to claim 1, wherein said gear arrangement further comprises a gearing arranged between said rotating member and the other of said supply reel and said take-up reel.

3. A device according to claim 2, wherein said gearing between said rotating member and said other of said supply reel and said take-up reel is a wheel and disc gearing.

4. A device according to claim 3, wherein said wheel and disc gearing forms a sliding clutch.

5. A device for transferring a film from a backing tape onto a substrate, said device comprising:

a housing;

a supply reel rotatably mounted in said housing on a supply reel rotational axis;

a take-up reel rotatably mounted in said housing on a take-up reel rotational axis;

gear arrangement extending along a gear arrangement axis offset from said supply reel rotational axis and said take-up reel rotational axis; and an application member protruding from said housing to press backing tape extending from said supply reel onto a substrate;

wherein:

said supply reel and said take-up reel are non-coplanar.

6. A device according to claim 5, wherein said supply reel rotational axis is offset from said take-up reel rotational axis.

7. A device according to claim 5, wherein said gear arrangement axis extends in a hollow space in at least one of said supply reel and said take-up reel.

8. A device for transferring a film from a backing tape onto a substrate, said device comprising:

a housing;

a supply reel rotatably mounted in said housing on a supply reel rotational axis;

a take-up reel rotatably mounted in said housing on a take-up reel rotational axis and axially spaced from said supply reel;

an application member protruding from said housing to press backing tape extending from said supply reel onto a substrate; and a gear arrangement between said supply reel and said take-up reel and extending along a gear axis;

wherein:

said supply reel rotational axis, said take-up reel rotational axis, and said gear axis are all offset from one another.

9. A device according to claim 8, wherein:

said supply reel comprises a supply winding body; and said take-up reel comprises a take-up winding body.

10. A device according to claim 9, wherein said gear arrangement includes a rotating member rotatably mounted on a bearing sleeve surrounded by said take-up winding body and said supply winding body.

11. A device according to claim 8, wherein:

said supply reel has a first diameter, said take-up reel has a second diameter; and said first diameter is smaller than said second diameter.

12. A device according to claim 8, wherein said take-up reel is offset relative to said supply reel in a direction toward said application member.

13. A device according to claim 8, wherein said rotational axis of said supply reel is offset relative to said gear axis in a direction toward said application member.

14. A device according to claim 8, wherein said gear arrangement includes a first gearing formed as a toothed wheelwork with a hollow toothed ring on one of said supply reel and said take-up reel.

15. A device according to claim 14, wherein said first gearing is a step-up gearing.

16. A device according to claim 14, wherein said gear arrangement includes a rotating member mounted on a portion of said one of said reels on which said hollow toothed ring is, adjacent to the other of said take-up reel and said supply reel.

17. A device according to claim 8, wherein said gear axis is arranged in a hollow space of the other of said supply reel and said take-up reel.

18. A device according to claim 8, wherein said supply reel and said take-up reel axially abut each other.

19. A device according to claim 8, wherein:

one of said supply reel and said take-up reel has a reel ring wall with an inner edge portion;

said gear arrangement has a first flange wall; and said inner edge portion of said reel ring wall laterally abuts said flange wall of said rotating member with axial stress.

20. A device according to claim 19, wherein at least one of said reel ring wall and said flange wall is made of resiliently flexible material.

21. A device according to claim 19, wherein said reel ring wall and said flange wall abut each other with inherent elastic stress.

22. A device according to claim 19, wherein said gear arrangement has a second flange wall, said flange walls having an axial gap therebetween and protruding beyond said reel ring wall and engaging said reel ring wall on both sides with axial stress.

23. A device according to claim 8, wherein:

said housing comprises two housing parts; and a division joint between said housing parts extends parallel to a rotational plane of said supply reel and said take-up reel.

24. A device according to claim 23, wherein a pivot bearing for said supply reel and said take-up reel is arranged on each of said housing parts.

* * * * *